United States Patent [19]

Choy et al.

[11] Patent Number: 4,668,205

[45] Date of Patent: May 26, 1987

[54] TOY VEHICLE FOR SIMULATING VEHICLE AND AIRCRAFT

[75] Inventors: Terence A. Choy, Redondo Beach; Harold A. Hartleben, Boyle Heights, both of Calif.

[73] Assignee: Mattel, Inc., Hawthorne, Calif.

[21] Appl. No.: 781,298

[22] Filed: Sep. 27, 1985

[51] Int. Cl.[4] ..... A63H 27/00

[52] U.S. Cl. ..... 446/230; 446/465; 446/487

[58] Field of Search ..... 446/94, 95, 104, 230, 446/231, 269, 279, 376, 465, 466, 487; D21/150, 166

[56] References Cited

U.S. PATENT DOCUMENTS

| | | | |
|---|---|---|---|
| D. 279,916 | 7/1985 | Obara | D21/150 X |
| D. 281,001 | 10/1985 | Ohno | D21/166 X |
| D. 281,087 | 10/1985 | Ohno | D21/166 X |
| D. 281,088 | 10/1985 | Murakami | D21/150 |
| D. 283,717 | 5/1986 | Obara | D21/150 X |
| 4,167,830 | 9/1979 | Ogawa | 446/94 X |
| 4,183,173 | 1/1980 | Ogawa | 446/94 |
| 4,206,564 | 6/1980 | Ogawa | 446/94 |
| 4,516,948 | 5/1985 | Obara | 446/95 |
| 4,571,201 | 2/1986 | Matsuda | 446/85 |
| 4,571,203 | 2/1986 | Murakami | 446/95 |
| 4,578,046 | 3/1986 | Ohno | 446/376 |
| 4,580,993 | 4/1986 | Ohno | 446/376 |
| 4,586,911 | 5/1986 | Murakami | 446/376 |

FOREIGN PATENT DOCUMENTS

| | | | |
|---|---|---|---|
| 2128489 | 5/1984 | United Kingdom | 446/95 |

*Primary Examiner*—Richard T. Stouffer

*Attorney, Agent, or Firm*—Ronald M. Goldman; Melvin A. Klein; Daniel F. Sullivan

[57] ABSTRACT

A toy that can be used to simulate a vehicle or an aircraft is presented. The toy has a hood rotatably coupled to its front end which may be opened and closed. A rear portion is rotatably coupled to the rear end of the toy and may be rotated to two positions in order to simulate the tail portion of an aircraft and the back of a vehicle. Wing extensions are rotatably coupled to wing supports extending from the sides of the toy. A wheel is rotatably coupled to each wing extension. The wing extensions may be rotated to a vertical position so that the wheels will rest on a supporting surface and support the rear end of the toy. As such, the toy simulates a vehicle when the wing extensions are rotated to a vertical position and simulates an aircraft when the wing extensions remain in a horizontal position. Swingarms supporting simulated guns are rotatably coupled to the sides of the toy. A toy doll may be placed inside the toy and used in conjunction with the swingarms.

5 Claims, 5 Drawing Figures

TOY VEHICLE FOR SIMULATING VEHICLE AND AIRCRAFT

BACKGROUND OF THE INVENTION

The present invention relates generally to toy vehicles and toy aircrafts and, more particularly, to a toy with integral adjustable parts which can be used to simulate both a vehicle and an aircraft.

In the past, a variety of toy vehicles and toy aircrafts have been fabricated. Some toys have been used for the purpose of simulating both a vehicle and an aircraft. For example, U.S. Pat. No. 4,183,173 discloses a toy used to simulate an automobile or aircraft. The rear wheel unit of the toy is removable to allow a toy airplane to be mounted. However, due to the number of removable parts used for such toys, parts of the toys are often lost or misplaced. This leads to increased expense and trouble due to the necessity of replacing missing parts. In most cases, the toy must be repurchased or discarded because spare parts are not available.

A toy with adjustable parts used to simulate both a vehicle and an aircraft, which are incorporated into and made an integral part of the toy, would eliminate the problems associated with lost parts. Since such a toy may be used as both a vehicle and an aircraft, a child may play with the toy in a variety of different ways. Accordingly, there is a need in the toy manufacturing arts for a toy with integral adjustable parts which may be used to simulate both a vehicle and an aircraft.

SUMMARY OF THE INVENTION

It is an object of this invention to provide a toy which may be used to simulate both a vehicle and an aircraft.

It is another object of this invention to provide a toy with integral adjustable parts used to simulate both a vehicle and aircraft.

It is still another object of this invention to provide a toy which may be used in conjunction with a toy doll when the toy is used to simulate a vehicle or aircraft.

These and other objects and advantages are attained by a toy that has a hood rotatably coupled to its front end which may be opened and closed. A rear portion of the toy is rotatably coupled to the rear end of the toy and may be rotated into two positions in order to simulate the tail portion of an aircraft and the back of a vehicle. Wing extensions are rotatably coupled to wing supports extending from the sides of the toy. A wheel is rotatably coupled to each wing extension. The wing extensions may be rotated to a vertical position so that the wheels will rest on a supporting surface and support the rear end of the toy. As such, the toy simulates a vehicle when the wing extensions are rotated to a vertical position and simulates an aircraft when the wing extensions remain in a horizontal position. Swingarms supporting simulated guns are rotatably coupled to the sides of the toy. A toy doll may be placed inside the toy and used in conjunction with the swingarms.

The various features of the present invention will be best understood, together with further objects and advantages by reference to the following description of the preferred embodiment, taken in connection with the accompanying drawings.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a commerical environment, although it should be understood that various modifications can be accomplished within the parameters of the present invention.

Figure 1:
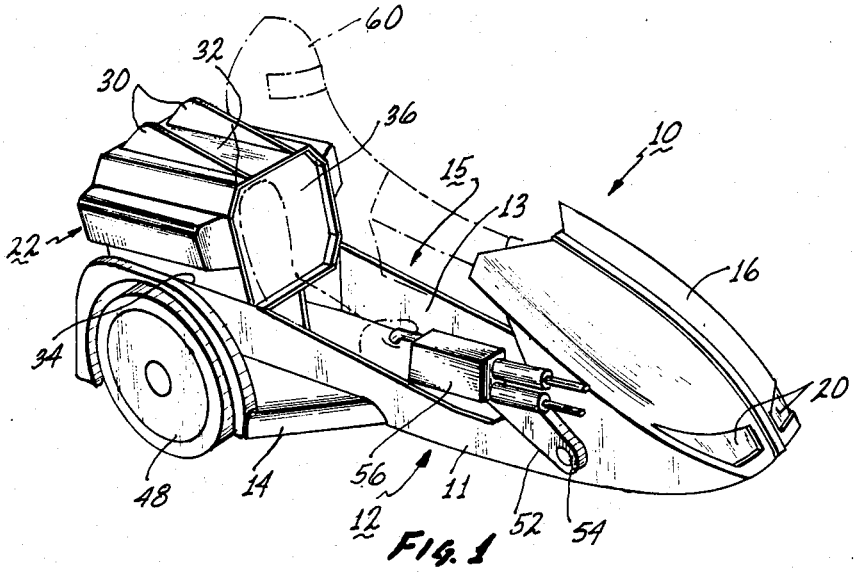
FIG. 1 is a perspective view of the preferred embodiment of the toy of the present invention showing the toy simulating a vehicle.
Figure 2:
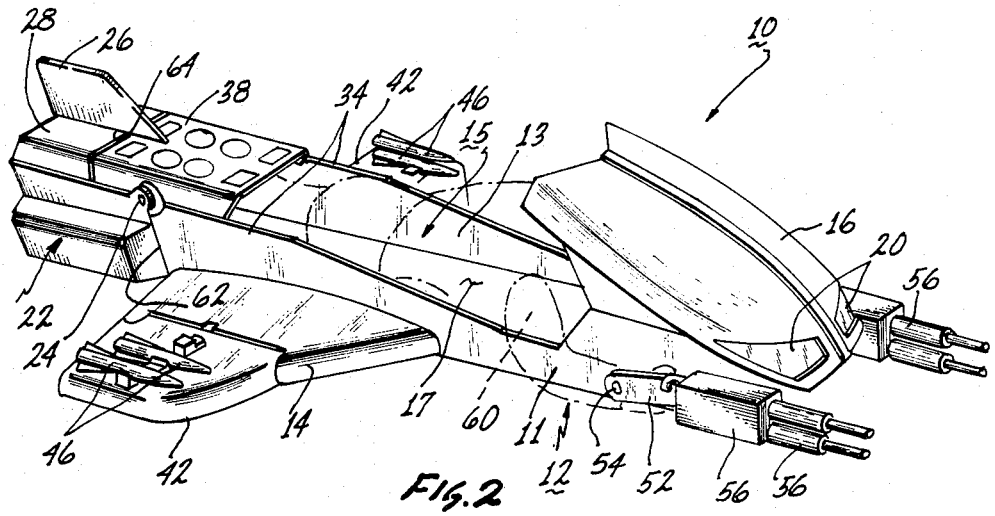
FIG. 2 is a perspective view of the preferred embodiment of the toy of the present invention showing the toy simulating an aircraft.
Figure 3:
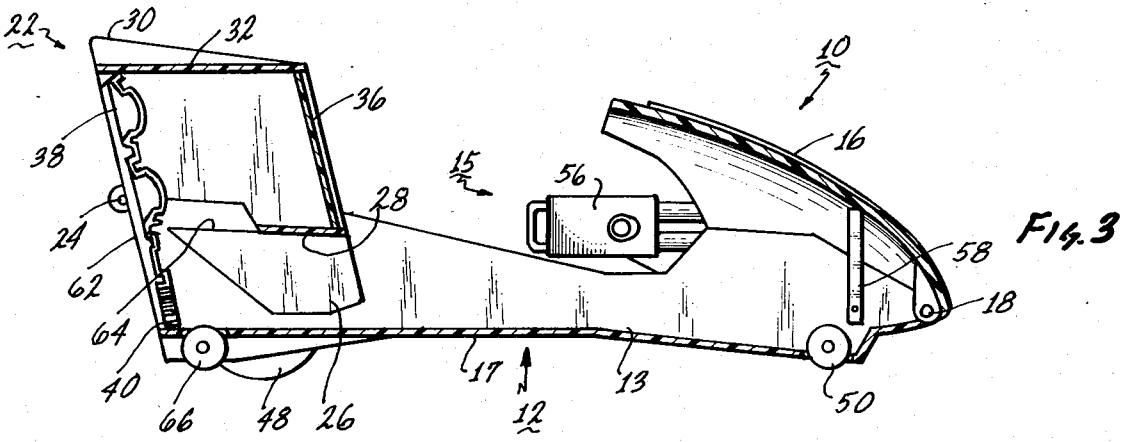
FIG. 3 is a partial longitudinal cross-sectional view of the toy of FIG. 1.
Figure 4:
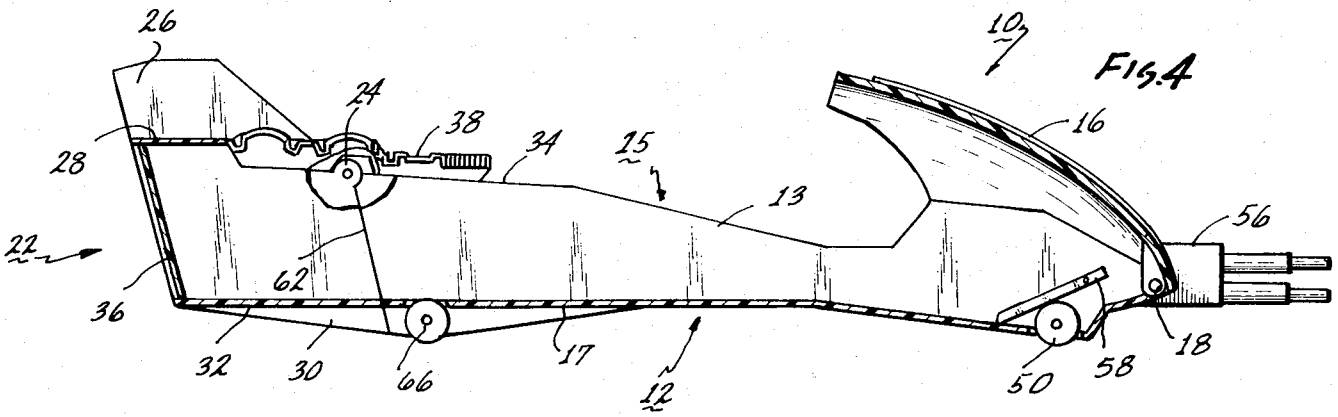
FIG. 4 is a partial longitudinal cross-sectional view of the toy of FIG. 2.

Referring now to the drawings and particularly to FIGS. 1 and 2, a preferred embodiment of the toy 10 of the present invention is disclosed. The toy 10 has has a body portion 12 with wing supports 14 extending from upwardly disposed sides 11 and 13 (see FIG. 5). The sides 11 and 13 and bottom 17 of the body portion 12 form a generally elongated compartment 15. A front hood 16 is rotatably coupled to the front of the body portion 12 at pivot point 18 as best shown in FIGS. 3 and 4. The hood 16 preferably has simulated windows 20 as shown in FIGS. 1, 2 and 5.

As best shown in FIGS. 2 and 4, the toy 10 has a rear portion 22 which is rotatably coupled to the rear of the body portion 12 at pivot point 24. A tail 26 extends from one side 28 of the rear portion 22 while fins 30 extend from the opposite side 32. As illustrated in FIGS. 1 through 4, the rear portion 22 can be rotated about pivot point 24 so that it can be disposed in two different positions. In a first position shown in FIGS. 1 and 3, the rear portion 22 is rotated until it rests on top of edges 34 of sides 11 and 13. In this position, the fins 30 are disposed in an upward direction and a simulated back support 36 (see FIG. 1) is provided.

A panel 38 is also rotatably coupled to the body portion 12 at pivot point 24. When the rear portion 22 is disposed in the first position, the panel 38 may be rotated about pivot point 24 until it comes into contact with the body portion 12 at point 40 as shown in FIG. 3. When disposed in this position, the panel 38 functions as a back side of the toy 10.

Figure 5:
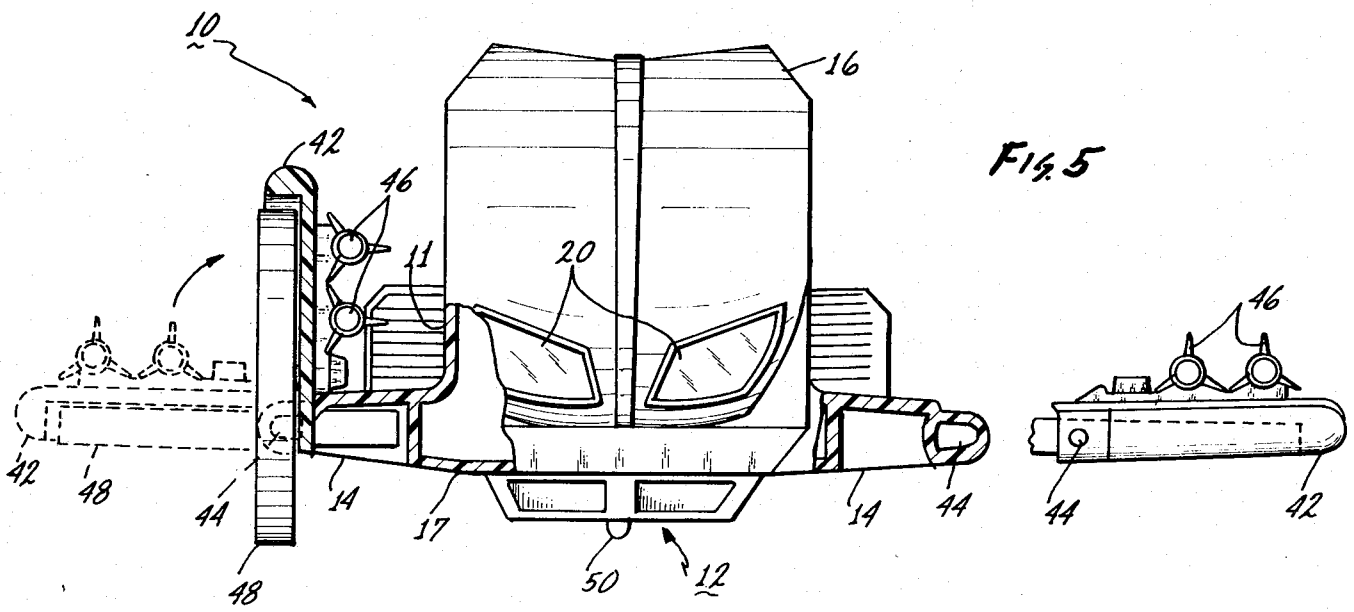
FIG. 5 is a front end view of the preferred embodiment of the toy of the present invention in partial cross-section with part of the toy's front end broken away to show how wing extensions may be pivoted to provide side wheels for the toy.

Wing extensions 42 are rotatably coupled to the wing supports 14 at pivot points 44 (see FIG. 5). Simulated missles 46 are preferably attached to the top sides of the wing extensions 42. Also, side wheels 48 are rotatably coupled to the bottom sides of the wing extensions 42 within depressions as shown in FIGS. 1 and 5. As best shown in FIG. 5, the wing extensions 42 may be rotated to an upward position so that the side wheels 48 will support the back of the toy 10 while a wheel 50 rotatably coupled to the bottom 17 of the body portion 12 supports the front of the toy 10. More than one wheel 50 may be used if desired. When the rear portion 22, panel 38 and side wheels 48 are positioned as shown in FIGS. 1 and 3, the toy 10 simulates a vehicle.

The toy 10 preferably has swingarms 52 rotatably coupled to both sides 11 and 13 of the body portion 12 at pivot points 54. Note that only one of the two swingarms 52 is shown in FIGS. 1 and 2. Simulated guns 56 are rotatably coupled to the ends of the swingarms 52 as shown in FIGS. 1, 2 and 3. Note that a smaller panel 58 is rotatably coupled to body portion 12 as shown in FIGS. 3 and 4. The panel 58 may be coupled to the sides 11 and 13 as shown in FIGS. 3 and 4 or to the bottom 17 (not shown) if desired.

A toy doll 60 may be placed inside compartment 15 of the toy 10 as illustrated by dashed lines in FIG. 1 when the toy 10 is configured to simulate a vehicle. In such a case, the smaller panel 58 may be positioned as shown in FIG. 3 to support the feet of the doll 60 and the swingarms 52 may be rotated backward in order to position the guns 56 near the doll so that the hands of the doll 60 may be brought into contact with the guns 56 if desired. The back support 36 may be used to support the doll 60. Note that the front hood 16 may be opened to facilitate placing the doll 60 in the toy 10 by simply rotating the hood about pivot point 18.

The toy 10 may be used to simulate an aircraft as shown in FIGS. 2 and 4 by rotating the rear portion 22 to a second position. This is accomplished by rotating the rear portion 22 about pivot point 24 until it comes into contact with rear edges 62 of sides 11 and 13. When so positioned, the tail 26 is disposed in an upward direction and support 36 is positioned to function as the back side of the toy 10. The panel 38 may then be rotated about common pivot point 24 until it comes into contact with bottom edge 64 of the tail 26 (see FIGS. 2 and 3). The wing extensions 42 may be disposed in a horizontal position as shown in FIG. 2 in order to simulate the wings of an aircraft. In order to facilitate placing the doll toy 60 in a prone position inside compartment 15 as illustrated by dashed lines in FIG. 2, the front hood 16 and panel 38 may be opened (moved out of the way) by rotating each part about pivot points 18 and 24, respectively. In addition, the smaller panel 58 may be positioned as shown in FIG. 4 in order to provide additional space at the front of the toy 10. When the wing extensions 42 are positioned as shown in FIG. 2, a wheel 66 rotatably coupled to the bottom 17 of the body portion 12 as shown in FIGS. 3 and 4 is used to support the back of the toy 10. More than one wheel 66 may be used if desired. Note that the swingarms 52 may be rotated as shown in FIG. 2 in order to position the guns 56 toward the front of the toy doll 60 so that the hands of the doll 60 may be brought into contact with the guns 56 if desired.

The various parts of the toy 10 are preferably molded out of plastic material. However, any other suitable material or method of fabrication may be used.

The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention.

We claim:

1. A toy for simulating a vehicle and an aircraft comprising:

a body portion having a bottom and two upwardly extending sides forming a generally elongated compartment capable of containing a toy doll, said body portion having horizontal wing supports attached to said upwardly extending sides;

a front hood rotatably coupled to the front of said body portion;

wing extensions rotatably coupled to said wing supports adjacent horizontal edges of said wing supports extending outermost from said upwardly extending sides, each of said extensions having a depression in one side thereof and a wheel rotatably coupled thereto within said depression, said wing extensions capable of being rotated with respect to said wing supports from a horizontal position to a vertical position so that each wheel rests on a supporting surface and supports the rear of said toy;

swingarms rotatably coupled to said two upwardly extending sides, each of said swingarms having a member simulating guns rotatably coupled to one end thereof and capable of being disposed so that said member may be used in conjunction with a hand of said toy doll;

a plurality of supporting wheels rotatably coupled to said bottom of said body portion;

a first panel rotatably coupled to said rear of said body portion adjacent top edges of said upwardly extending sides;

a second panel rotatably coupled to said body portion within said generally elongated compartment adjacent said front of said body portion, said second panel capable of being selectively positioned to support the feet of said toy doll and to facilitate disposing the head of said toy doll within said compartment near said front of said body portion; and rear portion means rotatably coupled to the rear of said body portion for simulating a tail portion of an aircraft by rotating said rear portion means into a first position and simulating a back of a vehicle by rotating said rear portion into a second position, said rear portion means including a tail and a simulated back support attached thereto, said first position disposing said tail in a downward direction and said second position disposing said tail in an upward direction.

2. A toy for simulating a vehicle and an aircraft comprising:

a body portion having a bottom and two upwardly extending sides, said body portion having wing supports attached to said upwardly extending sides;

a front hood rotatably coupled to the front of said body portion;

wing extensions rotatably coupled to said wing supports, each of said wing extensions having a wheel rotatably coupled to one side thereof, said wing extensions capable of being rotated to a vertical position so that each wheel rests on a supporting surface and supports the rear of said toy;

swingarms rotatably coupled to said two upwardly extending sides, each of said swingarms having a member simulating guns rotatably coupled to one end thereof;

a plurality of supporting wheels rotatably coupled to said bottom of said body portion; and rear portion means rotatably coupled to the rear of said body portion for simulating a tail portion of an aircraft by rotating said rear portion means into a first position and simulating a back of a vehicle by rotating said rear portion into a second position, said rear portion means including a tail attached thereto, said first position disposing said tail in a downward direction and said second position disposing said tail in an upward direction.

3. The toy of claim 2 further comprising a first panel rotatably coupled to said rear of said body portion.

4. The toy of claim 3 wherein said rear portion means includes a simulated back support attached thereto.

5. The toy of claim 4 wherein said body portion has a second panel rotatably coupled thereto adjacent said front of said body portion.

* * * * *